US011236904B2

(12) United States Patent
Makino et al.

(10) Patent No.: US 11,236,904 B2
(45) Date of Patent: Feb. 1, 2022

(54) BED MEDIUM FOR FLUIDIZED BED

(71) Applicant: ITOCHU CERATECH CORPORATION, Seto (JP)

(72) Inventors: Hiroshi Makino, Seto (JP); Jun Sakamoto, Seto (JP); Takayuki Kameda, Seto (JP); Reiku Aoyama, Seto (JP); Shunichi Sato, Seto (JP); Yoji Okumura, Seto (JP)

(73) Assignee: Itochu Ceratech Corporation, Seto (JP)

( * ) Notice: Subject to any disclaimer, the term of this patent is extended or adjusted under 35 U.S.C. 154(b) by 132 days.

(21) Appl. No.: 16/823,847

(22) Filed: Mar. 19, 2020

(65) Prior Publication Data

US 2020/0217499 A1 Jul. 9, 2020

Related U.S. Application Data

(63) Continuation of application No. PCT/JP2019/001054, filed on Jan. 16, 2019.

(30) Foreign Application Priority Data

Jan. 19, 2018 (JP) ..... JP2018-007060

(51) Int. Cl.

| | |
|---|---|
| ***F23C 10/18*** | (2006.01) |
| ***C21D 1/53*** | (2006.01) |
| ***F23C 10/01*** | (2006.01) |
| ***F23G 5/30*** | (2006.01) |

(52) U.S. Cl.

CPC ..... *F23C 10/18* (2013.01); *C21D 1/53* (2013.01); *F23C 10/01* (2013.01); *F23G 5/30* (2013.01)

(58) Field of Classification Search

CPC ..... F23C 10/18; F23C 10/01; C21D 1/53; F23G 5/30

See application file for complete search history.

(56) References Cited

U.S. PATENT DOCUMENTS

| | | | | |
|---|---|---|---|---|
| 4,118,309 | A * | 10/1978 | Myers | B07B 13/003 201/3 |
| 5,641,327 | A | 6/1997 | Leas | |
| 7,566,428 | B2 * | 7/2009 | Warner | B01J 8/02 261/94 |
| 2004/0244289 | A1 | 12/2004 | Morozumi et al. | |
| 2017/0349846 | A1 * | 12/2017 | Ding | C10G 67/02 |

FOREIGN PATENT DOCUMENTS

| | | | |
|---|---|---|---|
| CN | 102399595 | A | 4/2012 |
| CN | 104121580 | A | 10/2014 |
| CN | 108800113 | A | 11/2018 |
| EP | 1 431 373 | A1 | 6/2004 |
| JP | S62-252816 | A1 | 11/1987 |
| JP | H03-047943 | B2 | 7/1991 |
| JP | H04-040095 | B2 | 7/1992 |
| JP | 2001-146482 | A1 | 5/2001 |
| JP | 2003-240209 | A1 | 8/2003 |
| JP | 2003-251434 | A1 | 9/2003 |
| JP | 2004-202577 | A1 | 7/2004 |
| JP | 2004-286387 | A1 | 10/2004 |
| JP | 2004-286388 | A1 | 10/2004 |
| JP | 2005-121342 | A1 | 5/2005 |
| JP | 2009-257695 | A | 11/2009 |
| JP | 2011-120969 | A | 6/2011 |
| JP | 2013-029245 | A1 | 2/2013 |

OTHER PUBLICATIONS

International Search Report and Written Opinion (Application No. PCT/JP2019/001054) dated Mar. 26, 2019.

Japanese Office Action (Application No. 2018-007060) dated May 22, 2018 (with English translation).

Japanese Decision to Grant (Application No. 2018-007060) dated Sep. 18, 2018 (with English translation).

Yi-Jie Ye, et al., "Bed Agglomeration Characteristics During Fluidized-Bed Combustion of Biomass Fuels," *Renewable Energy Resources*, vol. 25, No. 3, Jun. 2007, pp. 50-53.

Seán T. Mac an Bhaird, et al., "Analysis of Bed Agglomeration During Gasification of Wheat Straw in a Bubbling Fluidised Bed Gasifier Using Mullite as Bed Material," *Powder Technology*, 254, Mar. 31, 2014, pp. 448-459.

Extended European Search Report (Application No. 19741722.3) dated May 18, 2021.

Chinese Office Action (Application No. 201980004652.3) dated Jun. 2, 2021 (with English translation).

* cited by examiner

*Primary Examiner* — David J Laux

(74) *Attorney, Agent, or Firm* — Burr & Brown, PLLC

(57) ABSTRACT

Provided are: a useful bed medium for a fluidized bed with good fluidity, the bed medium being usable in a fluidized bed furnace using biomass material and coal material as fuel; and a useful bed medium for a fluidized bed with good durability, the bed medium not easily forming an agglomerate of its particles, and being resistant to collapsing. The bed medium for a fluidized bed in a fluidized bed furnace for combusting or gasifying the fuel is formed of artificially-produced spherical refractory particles containing not less than 40% by weight of Al2O3 and not more than 60% by weight of SiO2 and having an apparent porosity of not more than 5%, and a ratio by weight of agglomerated particles in the bed medium is not more than 20% after three heat treatment tests on the bed medium at 900° C. for 2 hours under coexistence with the fuel.

8 Claims, No Drawings

BED MEDIUM FOR FLUIDIZED BED

This application is a continuation of the International Application No. PCT/JP2019/001054 filed on Jan. 16, 2019, which claims the benefit under 35 U.S.C. § 119(a)-(d) of Japanese Application No. 2018-007060 filed on Jan. 19, 2018, the entireties of which are incorporated herein by reference.

BACKGROUND OF THE INVENTION

Field of the Invention

The present invention relates to a bed medium or bed material for a fluidized bed. More particularly, the invention relates to a bed medium advantageously used to form a fluidized bed in a fluidized bed furnace for combusting or gasifying fuel comprising biomass material and/or coal material.

Description of Related Art

Conventionally, for incineration of biomass material such as construction waste wood materials, unseasoned wood, wood chips, PKS (Palm Kernel Shell), EFB (Empty Fruits Bunch) and wood pellets; coal; wastes such as urban garbage; and RDF (Refuse Derived Fuel), and for heat recovery from the incineration, combustion or gasification method in which the above-mentioned materials are fed into a fluidized bed furnace, and combusted or gasified in a fluidized bed formed in the fluidized bed furnace, has been widely employed in view of use as renewable energy and waste disposal of the above-mentioned materials. A bed medium or bed material used for forming the fluidized bed in the fluidized bed furnace is charged into the furnace having a cylindrical shape and subjected to violent fluidization due to air or reactive gas blown through a lower part of the furnace under heating, whereby the fluidized bed is formed, and also homogenization of the temperature in the furnace is achieved. Then, the furnace is provided with fuel such as the wastes like urban garbage, the coal or the biomass material from its upper part. The heat generated by combustion of the fuel permits power generation, and gasification of the fuel permits generation of an intended gas, as disclosed in JP2003-240209A and JP2005-121342A.

Meanwhile, as the bed medium for the above-mentioned fluidized bed furnace, naturally-produced silica sands such as river sand, sea sand and mountain sand have been widely used. The silica sand as the bed medium has the advantages that it is relatively inexpensive and easily available, and that its specific gravity is rather small. Since the bed medium is necessary to be violently fluidized by passing of the air or the reactive gas, a smaller specific gravity of the medium results in the advantage of a smaller amount of energy required for its fluidization, for example. However, in recent years, there has arisen a problem that the silica sand is getting more and more difficult to obtain because of progress of its exhaustion.

The silica sand also has an inherent problem that its use as the bed medium results in easy occurrence of the so-called agglomeration phenomenon, in which the silica sand reacts with an alkali metal oxide ($K_2O$, $Na_2O$) included in an ash content, namely an incombustible component in the fuel, thereby making particles of the silica sand bonded to each other to form a lump. For example, JP2013-29245A discloses that the silica sand particles existing in a combustion zone adsorb a potassium compound on their surfaces, and the potassium compound permeates into the inside of the silica sand particles to generate a glass-like reactive product (for example, $SiO_2$—$K_2O$ compound). The generated reactive product has a melting point of not higher than 800° C., which is lower than the temperature in the furnace, so that it turns into a molten state. That is, the silica sand subjected to the permeation of the potassium compound has a $SiO_2$—$K_2O$ compound and the like in the molten state on its surface, whereby a plurality of silica sand particles are caused to fuse and agglomerate with each other. The fused and agglomerated silica sand particles fall down to the bottom of the furnace body and further fuse and agglomerate to form a larger lump. Such a large lump induces a failure of fluidization of the bed medium, resulting in difficulty in operation of the fluidized bed furnace. Meanwhile, the above-mentioned JP2013-29245A teaches that the problem of fusion and agglomeration of the particles used as the bed medium can be avoided by utilizing alumina particles as the bed medium, though the problem has not been solved sufficiently, in fact, by simply utilizing the alumina particles.

Furthermore, while the silica sand inherently has a problem of carcinogenicity because it is formed of crystalline silica, it also has a problem caused by its peculiar characteristic of thermal expansion. That is, the silica sand undergoes a phase transition from α-type to β-type at a temperature of 573° C., thereby experiencing significant cubical expansion. For this reason, the silica sand itself has a problem that it suffers from self-collapsing so as to be powdered due to repeated heating and cooling.

In addition, the silica sand generally consists of angular particles. Thus, where the silica sand is used as the bed medium, the particles are allowed to contact and collide with each other during fluidization in which the bed medium is violently fluidized in the furnace, so that angular portions of the silica sand particles are crushed to generate fine powder. Since the generated fine powder does not serve as the bed medium, it is captured as collected dust and disposed as waste. As such, the silica sand also has a problem in its durability.

SUMMARY OF THE INVENTION

The present invention was completed in view of the background art described above. Therefore, a problem to be solved by the present invention is to provide a useful bed medium for a fluidized bed with good fluidity, which medium can be used as a bed medium in a fluidized bed furnace using biomass material and/or coal material as fuel. It is another problem to be solved by the invention to provide a useful bed medium for a fluidized bed with good durability, which medium is not likely to form an agglomerate of its particles, and is resistant to collapsing.

In order to solve the above-mentioned problems, the present invention can be preferably embodied in various modes which will be described below. The various modes of the invention described below may be practiced in any combination thereof. It is to be understood that the modes and technical features of the present invention are not limited to those described below, and can be recognized based on the inventive concept disclosed in the specification taken as a whole.

To solve the above-mentioned problems, the present invention provides a bed medium for a fluidized bed, which medium is introduced into a fluidized bed furnace for combusting or gasifying fuel comprising biomass material and/or coal material, and is fluidized to form the fluidized bed within the furnace into which the fuel is to be fed, wherein the bed medium is formed of artificially-produced spherical refractory particles having a chemical composition containing not less than 40% by weight of $Al_2O_3$ and not more than 60% by weight of $SiO_2$; apparent porosity of the bed medium is not more than 5%; and a ratio by weight of agglomerated particles in the bed medium is not more than 20% after the bed medium has been subjected to a heat treatment test three times at a temperature of 900° C. for 2 hours under coexistence with the fuel.

In one preferable embodiment of the bed medium for a fluidized bed according to the invention, the refractory particles are mullite particles or mullite-corundum particles.

In another preferable embodiment of the bed medium for a fluidized bed according to the invention, the refractory particles have an apparent porosity of not more than 3.5%.

In another desirable embodiment of the bed medium for a fluidized bed according to the invention, the refractory particles have a roundness of not less than 0.70.

Additionally, in the invention, the refractory particles preferably have a chemical composition containing 50-90% by weight of $Al_2O_3$ and 50-10% by weight of $SiO_2$.

In the invention, the refractory particles advantageously have an apparent porosity of not more than 3.0%.

In still another desirable embodiment of the bed medium for a fluidized bed according to the invention, the refractory particles are constituted to have a crush rate of not more than 20% in a crushability test.

Furthermore, in one of the other preferable embodiments of the bed medium for a fluidized bed according to the invention, the refractory particles have a bulk density of 2.60-3.20 g/cm$^3$.

In summary, the bed medium for a fluidized bed according to the invention is formed of the artificially-produced spherical refractory particles comprising $Al_2O_3$ and $SiO_2$ and has an apparent porosity of not more than 5%, while the medium is characterized in that the ratio by weight of agglomerated particles in the medium is not more than 20% after the repeated heating tests. Thus, the bed medium according to the invention is quite excellent in fluidity as a bed medium, and the medium is effectively protected from fusion of the particles with each other due to the existence of an alkali metal oxide, and the resultant formation of the agglomerate of the particles. Furthermore, the above-mentioned refractory particles are free from crystalline silica, and also have: a low degree of thermal expansion; a spherical shape without any angular portion; and a high degree of hardness, so that the refractory particles are resistant to collapsing. Thus, the refractory particles are economically advantageously usable as a highly-durable bed medium for a long period of time.

DETAILED DESCRIPTION OF THE INVENTION

A bed medium for a fluidized bed according to the present invention is formed of artificially-produced spherical refractory particles, and has a chemical composition containing not less than 40% by weight of $Al_2O_3$ and not more than 60% by weight of $SiO_2$. Where the content of $Al_2O_3$ is less than 40% by weight, or in other words, the content of $SiO_2$ is more than 60% by weight, thermal expansion of the refractory particles is increased so as to cause abnormal expansion which is characteristic to $SiO_2$, resulting in self-collapsing of the particles. In addition, reactivity of the refractory particles with an alkaline component in fuel is also increased, resulting in easy occurrence of agglomeration of the particles. In particular, mullite refractory particles having the above-mentioned chemical composition are suitably used in the invention.

To advantageously achieve the object of the present invention, in the chemical composition of the refractory particles, $Al_2O_3$ is preferably contained in an amount of not less than 50% by weight, and more preferably in an amount of not less than 60% by weight, with the upper limit being 99.9% by weight in general, preferably 90% by weight, and more preferably about 80% by weight. On the other hand, $SiO_2$ is preferably contained in an amount of not more than 50% by weight, and more preferably in an amount of not more than 40% by weight, with the lower limit being 0.1% by weight in general, preferably 10% by weight, and more preferably about 20% by weight. Among them, a chemical composition containing 50-90% by weight of $Al_2O_3$ and 50-10% by weight of $SiO_2$ is advantageously employed, and a chemical composition containing 60-80% by weight of $Al_2O_3$ and 40-20% by weight of $SiO_2$ is further suitably employed. The chemical composition can be measured with a common x-ray fluorescence analyzer, for example.

The $Al_2O_3$—$SiO_2$-based refractory particles according to the invention are constituted to have an apparent porosity of not more than 5%. Thus, the particles are effectively inhibited from being subjected to permeation and condensation therein of the alkali component contained in fuel, resulting in effective prevention of the occurrence of agglomeration of the particles. It is also permitted to prevent formation of a bed medium containing a large amount of impurities, thereby contributing to use of the particles for a longer period of time. Where the apparent porosity exceeds 5%, the agglomeration of the particles is likely to occur. Besides, mechanical strength of the particles themselves is deteriorated, resulting in easy breakage of the particles, for example. To advantageously achieve the object of the present invention, the apparent porosity of the particles is preferably controlled to be not more than 3.5%, and particularly preferably not more than 3.0%. The apparent porosity is measured according to the method defined in the JIS-R-2205.

Furthermore, after the above-mentioned spherical refractory particles constituting the bed medium for a fluidized bed according to the invention are subjected to an agglomeration evaluation test three times, which test consists of a heat treatment at 900° C. for 2 hours under coexistence of the refractory particles and fuel (biomass material and/or coal material), the ratio of agglomerated particles in the refractory particles is characteristically not more than 20% on the weight basis. Although the ratio by weight of agglomerated particles after the predetermined heat treatment test is defined to be not more than 20% in the invention, the less the ratio is, the better. Thus, the spherical refractory particles are advantageously controlled to have a ratio by weight of agglomerated particles not more than 10%, and particularly preferably not more than 5%. The ratio by weight of agglomerated particles in the refractory particles is measured by a heat treatment test including the steps of mixing 30 g of the fuel with 50 g of the bed medium (refractory particles) and heating the mixture at 900° C. for 2 hours. The heat treatment test is repeated three times, with 30 g of the fuel being added at every heat treatment. Then, the bed medium after the test is sieved with a standard sieve of 12 mesh (1.4 mm). The particles remained on the sieve is regarded as the agglomerated particles, and its ratio by weight is calculated.

The above-mentioned spherical refractory particles preferably have a roundness of not less than 0.70. More specifically, the refractory particles having a roundness of not less than 0.75, and further preferably not less than 0.80, are advantageously used. Use of the spherical refractory particles having a roundness in the above-mentioned range permits advantageous fluidization of the particles in the fluidized bed furnace, whereby the fluidized bed is easily formed. The roundness is measured with a particle shape analyzer: PartAn SI manufactured by MicrotracBEL Corporation, JAPAN. The analyzer includes a sample cell, a stroboscopic LED and a high-speed CCD video camera, and measures the roundness as follows. While circulating water by a pump, a sample (refractory particles) is fed into the water, so that the water containing the sample particles is allowed to pass through the sample cell arranged between the stroboscopic LED as a light source and the CCD video camera. A projection image obtained during the passing is analyzed to thereby measure the projection area of an individual particle and the maximum Feret diameter. The roundness of the individual particle is calculated from the value of the obtained maximum Feret diameter and the projection area, according to the following formula:

$$\text{Roundness}=[4\times\text{Projection area (mm}^2)]/[\pi\times\{\text{Maximum Feret diameter (mm)}\}^2]$$

More specifically described, initially, not less than 5000 of refractory particles are fed into the analyzer, and the roundness of the individual particle is calculated. Then the total of the obtained values of the roundness is averaged by the number of the analyzed particles, whereby the roundness (mean value) of the refractory particles is obtained.

The above-mentioned spherical refractory particles used as the bed medium for a fluidized bed according to the invention preferably have a crush rate of not more than 20%, more preferably not more than 10%, and further preferably not more than 5% in a crushability test. Where the refractory particles having a crush rate in the above-mentioned range are used as the bed medium, the bed medium can be advantageously utilized as a reusable bed medium, by performing a reclamation treatment such as mechanical polishing to the used bed medium taken out of the fluidized bed furnace. The crushability test employed here is the method according to "Test method of crushability of the casting sand (S-6)" defined by the Japan Foundry Society. Specifically described, initially, test sand is provided in an amount controlled such that the volume of the test sand is the same as the volume of 600 g of standard particles, and the test sand is fed into a porcelain ball mill having a capacity of 5 L, together with 40 of alumina balls having a diameter of 20 mm. Then, a crushing treatment is performed for 60 minutes, so as to measure the particle size distribution of the refractory particles after the crushing treatment and obtain a grain fineness number (AFS. GFN). The crush rate (%) is thus calculated according to the following formula:

$$\text{Crush rate (\%)}=[(\text{AFS. GFN after crushing}-\text{AFS. GFN before crushing})/(\text{AFS. GFN before crushing})]\times 100$$

The above-mentioned artificially-produced spherical refractory particles used as the bed medium according to the invention preferably have a particle diameter which is equivalent to that of a bed medium used in the conventional fluidized bed furnace, and is suitably determined depending on types of fluidized bed and other operating conditions. For example, in a bubbling-type fluidized bed, BFB (Bubbling Fluidized Bed), particles having a diameter equivalent to those of the conventionally-used silica sand Nos. 4 and 5 are used, and in a circulation-type fluidized bed, CFB (Circulating Fluidized Bed), particles having a diameter equivalent to those of the silica sand Nos. 6 and 7 are used. The average particle diameter ($D_{50}$) of those refractory particles used in the fluidized bed is generally about 0.05-3.0 mm, preferably about 0.07-1.0 mm, and more preferably about 0.1-0.5 mm.

Furthermore, the spherical refractory particles according to the invention preferably have a bulk density of 2.60-3.20 g/cm$^3$. The refractory particles having a bulk density in the above-mentioned range permit advantageous formation of an intended fluidized bed. For example, where the bulk density of the refractory particles is more than 3.20 g/cm$^3$, there arises a problem that a large amount of energy is required for fluidization, for example. Here, the bulk density is calculated according to the measuring method defined in the JIS-R-2205.

Meanwhile, the artificially-produced spherical refractory particles comprising $Al_2O_3$ and $SiO_2$, which are used as the bed medium for a fluidized bed according to the invention, can be produced according to various known methods using an $Al_2O_3$ source material and a $SiO_2$ source material. For example, to spheroidize the particles, initially a granule is formed according to a granulation method such as rolling granulation and spray-drying, and the obtained granule is subjected to sintering to thereby produce spherical sintered particles. It is also possible to form the spherical refractory particles as fused particles by subjecting the granule to a melting method, or as a melt-solidified product by subjecting the granule to a flame-fusion method.

Specifically described, the following methods are employed: a method of producing spherical particles employing the spray-drying method and the sintering method together, as disclosed in JPH03-47943A, JPH04-40095A and the like; a method of producing spherical particles employing the rolling granulation method and the sintering method together, as disclosed in JP2003-251434A; a method of forming spherical particles by blowing air to molten raw material, as disclosed in JP2004-202577A; and a production method called flame-fusion method, in which spherical particles are obtained by feeding raw material powder into the flame, and melting and spheroidizing the raw material powder, as disclosed in JP2004-202577A. In the above-mentioned production methods of the refractory particles, the spherical shape and the apparent porosity of the refractory particles to be obtained can be controlled by adjusting granulation conditions so as to form a highly dense granule, or suitably setting production conditions such as sintering conditions and melting conditions based on the knowledge of those skilled in the art.

The refractory particles obtained by the above-mentioned production methods can be used as the bed medium for a fluidized bed according to the invention as such. Alternatively, the refractory particles are used as an intended bed medium after a treatment for removing particles having an insufficient spherical shape and particles having an undesirably high apparent porosity. It is also possible to employ a sieving process as necessary, for obtaining refractory particles having a suitable particle diameter to form an intended fluidized bed.

It is possible to use various known kinds of biomass material and coal material as the fuel combusted or gasified in the fluidized bed furnace in which the bed medium according to the invention is used. Specifically described, examples of the biomass material include wood chips, construction waste wood materials, unseasoned wood, PKS (Palm Kernel Shell), EFB (for example, empty fruit bunch of Elaeis guineensis) which is the rest of a fruit after shelling, wood pellets, switchgrass, RDF (Refuse Derived Fuel) and papermaking sludge. On the other hand, examples of the coal materials include various coals such as peat, lignite, brown coal and anthracite coal; coke; and oil coke.

Although one typical embodiment of the invention has been described in detail for illustration purpose only, it is to be understood that the invention is not limited to the details of the preceding embodiment.

For example, fluidized bed furnaces having various known structures such as the circulation-type and the bubbling-type can be employed as the fluidized bed furnace in which the bed medium according to the invention is used. The bed medium according to the invention is advantageously used for forming the fluidized bed in these furnaces.

In such fluidized bed furnaces, the heat energy generated by combusting the above-mentioned fuel is suitably used for power generation, supply of hot water, generation of steam and the like. It is also possible to utilize gas generated by gasifying the biomass material and the coal material.

EXAMPLES

To clarify the present invention more specifically, some examples according to the invention will be described, but it goes without saying that the present invention is not limited to the details of the illustrated examples. It is to be understood that the present invention may be embodied with various other changes, modifications and improvements, which are not illustrated in the following examples or in the above description, and which may occur to those skilled in the art, without departing from the spirit and scope of the invention.

Example 1

Refractory particles A-H made of various kinds of material were produced according to the known production methods indicated in the following Table 1. Then, each of the refractory particles A-H was measured of its chemical composition, bulk density, apparent porosity, roundness and average particle size, the results of which are indicated in the following Table 1. The chemical composition of each of the refractory particles was measured with an x-ray fluorescence analyzer, its bulk density was measured according to the JIS-R-2205, and its apparent porosity was measured according to the measuring method defined in the JIS-R-2205 as well. Furthermore, the roundness of each of the refractory particles was calculated based on the above-mentioned formula for obtaining the roundness by using its projection area obtained by means of a particle shape analyzer: PartAn SI manufactured by MicrotracBEL Corporation, JAPAN, and its maximum Feret diameter.

TABLE 1

| | | Refractory particle | | | | | | | |
|---|---|---|---|---|---|---|---|---|---|
| | | A | B | C | D | E | F | G | H |
| Material | | Mullite | Mullite | Mullite | Mullite | Alumina | Silica sand | Mullite | Alumina |
| Chemical Composition | $Al_2O_3$ (%) | 60.47 | 53.42 | 76.46 | 61.79 | 99.5 | 2.91 | 60.45 | 99.4 |
| | $SiO_2$ (%) | 36.66 | 43.19 | 14.35 | 32.10 | 0.1 | 94.69 | 36.68 | 0.3 |
| Production method | | Spray-drying/ Sintering | Rolling granulation/ sintering | Fusion atomizing | Flame-fusion | Rolling granulation/ sintering | Naturally produced | Spray-drying/ Sintering | Rolling granulation/ Sintering |
| Bulk density ($g/cm^3$) | | 2.75 | 2.71 | 3.12 | 2.80 | 3.81 | 2.60 | 2.65 | 3.37 |
| Apparent porosity (%) | | 1.6 | 3.1 | 3.8 | 1.0 | 2.5 | 4.4 | 8.0 | 12.6 |
| Roundness | | 0.8 | 0.7 | 0.9 | 0.9 | 0.8 | 0.6 | 0.7 | 0.7 |
| Average particle size (mm) | | 0.21 | 0.34 | 0.23 | 0.25 | 0.34 | 0.28 | 0.22 | 0.35 |

Subsequently, 50 g of each of the refractory particles A-H was provided, and mixed with 30 g of empty fruit bunch of Elaeis guineensis in the form of pellet (EFB pellet) as biomass fuel. The obtained mixture was subjected to a heat treatment three times at a temperature of 900° C. for 2 hours in an electric furnace. On repeating the heat treatment, residue of the biomass fuel and the refractory particle (bed medium) were separated to recover the refractory particle, and 30 g of the fresh biomass fuel (EFB pellet) was added to the recovered refractory particle to form a mixture. Then, the mixture was subjected to the subsequent heat treatment.

After the heat treatment was repeated three times, the residue of the biomass fuel and the refractory particle (bed medium) were separated again to recover the refractory particles. Then, the recovered refractory particle was sieved with a standard sieve of 12 mesh (1.4 mm), and the ratio by weight of a lump remaining on the sieve was defined as the amount of agglomerated particles, the results of which are indicated in the following Table 2.

TABLE 2

| Refractory particle (bed medium) | Amount of agglomerated particles (weight %) |
|---|---|
| A | 2 |
| B | 10 |
| C | 15 |
| D | 12 |
| E | 1.5 |

TABLE 2-continued

| Refractory particle (bed medium) | Amount of agglomerated particles (weight %) |
|---|---|
| F | 70 |
| G | 28 |
| H | 24 |

As is apparent from the results shown in Tables 1 and 2, in the refractory particles A-E according to the invention, the amount of agglomerated particles was not more than 20%. In particular, the refractory particles A and E had significantly small amounts of agglomerated particles. On the other hand, in the refractory particle F consisting of the silica sand conventionally used as the bed medium, the amount of agglomerated particles was 70%, indicating that an extremely large amount of particles were agglomerated in the refractory particle F. Furthermore, the refractory particles G and H had increased amounts of agglomerated particles because of their apparent porosity over 5%. In addition, the refractory particles A and F were observed with respect to their state after the heat treatment test by using a microscopic photo, for examining the state of agglomeration of the particles. In the refractory particle A, the particles retained their spherical shape even after the heat treatment test. In contrast, in the refractory particle F, the particles fused with each other to lose their original form.

Example 2

A crushability test was conducted with respect to each of the refractory particles A-F shown in Table 1. First, the refractory particle A was provided in an amount of 600 g, and each of the other refractory particles was provided in an amount adjusted on the basis of its specific gravity such that the volume of each of the other refractory particles was equal to that of the refractory particle A. Subsequently, each of the provided refractory particles was accommodated in a porcelain ball mill having a capacity of 5 L, together with 40 of alumina balls having a diameter of 20 mm. Then, a crushing treatment was performed for 60 minutes, so as to measure the particle size distribution of the refractory particle after the crushing treatment and obtain a grain fineness number (AFS. GFN). The crush rate (%) was calculated according to the following formula:

Crush rate (%)=[(AFS. GFN of the refractory particle after crushing−AFS. GFN of the refractory particle before crushing)/(AFS. GFN of the refractory particle before crushing)]×100

The results are shown in the following Table 3.

TABLE 3

| Refractory particle (bed medium) | Crush rate (%) |
|---|---|
| A | 2 |
| B | 10 |
| C | 20 |
| D | 10 |
| E | 2 |
| F | 30 |

As is apparent from the results shown in Table 3, each of the refractory particles A-E had a crush rate of as low as not more than 20%, so that it can be used as the bed medium for a fluidized bed which is excellent in durability. In contrast, the refractory particle F consisting of the silica sand conventionally used as the bed medium had a crush rate of 30%, indicating that it did not have a sufficient durability as the bed medium.

Example 3

The refractory particles as the bed medium were evaluated with respect to their roundness and fluidizability. As the refractory particles subjected to the evaluation, the refractory particles A-F in Table 1 were provided, and further a refractory particle I prepared separately was provided. The refractory particle I, consisting of particles having a roundness of 0.6, was produced by crushing mullite particles obtained by sintering a pressurized body formed of an $Al_2O_3$—$SiO_2$ material.

On evaluating the fluidizability, a fluidized bed was formed from each of the refractory particles and air was blown into the fluidized bed, whereby a degree of fluidization was observed. Specifically described, in the case where pressure drop (ΔP) became approximately constant in the fluidized bed by increasing the velocity of the blown air to a certain degree, the particle forming the fluidized bed was evaluated as a particle having good fluidizability. On the other hand, in the case where ΔP did not become constant when the velocity of the air was gradually increased, the particle forming the fluidized bed was evaluated as a particle having poor fluidizability. The results are shown in the following Table 4.

TABLE 4

| Refractory particle (bed medium) | Roundness | Fluidizability |
|---|---|---|
| A | 0.8 | Good |
| B | 0.7 | Good |
| C | 0.9 | Good |
| D | 0.9 | Good |
| E | 0.8 | Good |
| F | 0.6 | Good |
| I | 0.6 | Poor |

As is apparent from the results shown in Table 4, each of the refractory particles A-F exhibited good fluidizability. The refractory particle I was inferior with respect to the fluidizability in spite of its roundness identical to that of the refractory particle F consisting of the silica sand. This is because the refractory particle I was artificially produced but was a crushed product, which was not made spherical.

Example 4

With respect to each of the refractory particles shown in Table 1, an agglomeration test was performed by using a fluidized bed furnace for a test. The fluidized bed furnace was equipped with a reaction tube having an inner diameter of 35 mm. 50 ml of the refractory particle as a bed medium was filled in the reaction tube, and fluidizing gas was blown into the reaction tube from its bottom, while 120 g of biomass fuel (EFB pellet) was fed into the reaction tube after the tube was heated to 1100° C. The tube was held for 3 hours as such. By measuring the amount of agglomerated particles in the refractory particle after the agglomeration test, the agglomeration property of the refractory particle was evaluated. It is noted that the fluidizing gas blown into the reaction tube was a pressurized gas, and the flowing amount of the gas was controlled to be 1.5 times the minimum fluidization velocity ($U_{mf}$) of the refractory particle.

As known well, the minimum fluidization velocity ($U_{mf}$) indicates, in terms of the relationship between the velocity and the pressure drop of gas, the velocity of gas (fluidizing gas) at the time when the pressure drop remaining constant in the fluidized state turns to decrease. The larger the value of the minimum fluidization velocity, the more the gas is required to fluidize the fluidized bed, that is, the more the energy for fluidization is required. The minimum fluidization velocity is affected by the particle size distribution and the specific gravity of the bed medium (refractory particles). For this reason, in the Example, each of the refractory particles was subjected to a preliminary test for calculating its minimum fluidization velocity. Furthermore, in the agglomeration test, the refractory particles taken out of the reaction tube after the test were sieved with a standard sieve of 12 mesh, and a ratio by weight of the agglomerated refractory particles remaining on the sieve was defined as the amount of agglomerated particles. The results are shown in the following Table 5.

TABLE 5

| Refractory particle (bed medium) | Minimum fluidization velocity ($U_{mf}$: cm/s) | Amount of agglomerated particles (% by weight) |
|---|---|---|
| A | 4 | 0 |
| B | 10 | 3 |
| C | 6 | 8 |
| D | 5 | 5 |
| E | 15 | 0 |
| F | 6 | 20 |
| G | 4 | 15 |
| H | 13 | 12 |

As is apparent from the results shown in Table 5, the amount of agglomerated particles was not more than 10%, which is a quite small amount, in each of the refractory particles A-E. In contrast, the amount of agglomerated particles in the refractory particle F consisting of the conventional silica sand reached as much as 20%, indicating that the material F suffered from a quite large amount of agglomerated particles. In addition, the amount of agglomerated particles exceeded 10% in the refractory particles G and H having apparent porosity outside the range of the invention. It is recognized that these materials have an inherent problem that they suffer from a large amount of agglomerated particles when used as the bed medium. Meanwhile, each of the refractory particles A and F after the agglomeration test was examined with respect to the distribution of K (potassium) component therein, by means of an EPMA photo. As a result, it was recognized that the particles existed as mutually independent spherical particles in the refractory particle A, and the K component was only scarcely distributed around the particles. In contrast, it was recognized that the particles fused with each other due to the K component in the refractory particle F. Consequently, it is confirmed that the refractory particle A can be recycled and reused as a bed medium equivalent to a new sand, after a suitable treatment of shaving off of the K components around the particles by means of a mechanical polishing apparatus, for example.

The invention claimed is:

1. A bed medium for a fluidized bed, which medium is introduced into a fluidized bed furnace for combusting or gasifying fuel comprising biomass material and/or coal material, and is fluidized to form the fluidized bed within the furnace into which the fuel is to be fed, wherein:

the bed medium is formed of artificially-produced spherical refractory particles having a chemical composition containing not less than 40% by weight of $Al_2O_3$ and not more than 60% by weight of $SiO_2$;

apparent porosity of the bed medium is not more than 5%; and a ratio by weight of agglomerated particles in the bed medium is not more than 20% after the bed medium has been subjected to a heat treatment test three times at a temperature of 900° C. for 2 hours under coexistence with the fuel.

2. The bed medium for a fluidized bed according to claim 1, wherein the refractory particles are mullite particles or mullite-corundum particles.

3. The bed medium for a fluidized bed according to claim 1, wherein the refractory particles have an apparent porosity of not more than 3.5%.

4. The bed medium for a fluidized bed according to claim 1, wherein the refractory particles have a roundness of not less than 0.70.

5. The bed medium for a fluidized bed according to claim 1, wherein the refractory particles have a chemical composition containing 50-90% by weight of $Al_2O_3$ and 50-10% by weight of $SiO_2$.

6. The bed medium for a fluidized bed according to claim 1, wherein the refractory particles have an apparent porosity of not more than 3.0%.

7. The bed medium for a fluidized bed according to claim 1, wherein the refractory particles have a crush rate of not more than 20% in a crushability test.

8. The bed medium for a fluidized bed according to claim 1, wherein the refractory particles have a bulk density of 2.60-3.20 g/cm$^3$.

* * * * *